US005745022A

United States Patent [19]

Becher et al.

[11] Patent Number: 5,745,022

[45] Date of Patent: Apr. 28, 1998

[54] BIMETALLIC TEMPERATURE CONTROLLER HAVING A RESISTOR FOR SELF-LOCKING FUNCTION AND A RESISTOR FOR EXCESS CURRENT PROTECTION

[75] Inventors: Michael Becher, Althengstett; Edwin Güttinger, Königsbach, both of Germany

[73] Assignee: Thermik Geratebau GmbH, Pforzheim, Germany

[21] Appl. No.: 686,853

[22] Filed: Jul. 26, 1996

[30] Foreign Application Priority Data

Jul. 26, 1995 [DE] Germany ..... 195 27 254.4

[51] Int. Cl.[6] ..... H01H 37/14; H01H 61/02

[52] U.S. Cl. ..... 337/104; 337/333; 337/377

[58] Field of Search ..... 337/77, 104, 107, 337/324, 377, 333

[56] References Cited

U.S. PATENT DOCUMENTS

| | | | |
|---|---|---|---|
| 3,667,539 | 6/1972 | Sweger | 337/377 |
| 4,839,626 | 6/1989 | Hollweck | 337/377 |
| 5,039,843 | 8/1991 | Muller | 337/104 |
| 5,528,448 | 6/1996 | Brenner | 361/103 |

FOREIGN PATENT DOCUMENTS

| | | |
|---|---|---|
| 2138182 | 1/1973 | France . |
| 1 058 606 | 6/1959 | Germany . |
| 41 42 716 A1 | 6/1993 | Germany . |
| 43 36 564 A1 | 5/1994 | Germany . |

*Primary Examiner*—Leo P. Picard
*Assistant Examiner*—Jayprakash N. Gandhi
*Attorney, Agent, or Firm*—Harness, Dickey & Pierce, P.L.C.

[57] ABSTRACT

A temperature controller 10 with a bimetallic switching device comprising a bimetallic disk and current-carrying spring disk 22, displaying a first heating resistor assigned to the bi-metallic switching device which has the effect of a self-locking function when the bimetallic switching device is actuated. The bimetallic switching device is assigned a second heating resistor which switches the bimetallic switching device when the current flowing through the temperature controller 10 becomes too high to protect a consumer against excess current. The bimetallic switching device is hereby provided as change-over switch and is connected to both heating resistors 53, 54 in such a way that in each of its switch positions is takes over the current flowing through the temperature 10 controller via a current-carrying part 22.

18 Claims, 4 Drawing Sheets

Fig. 2
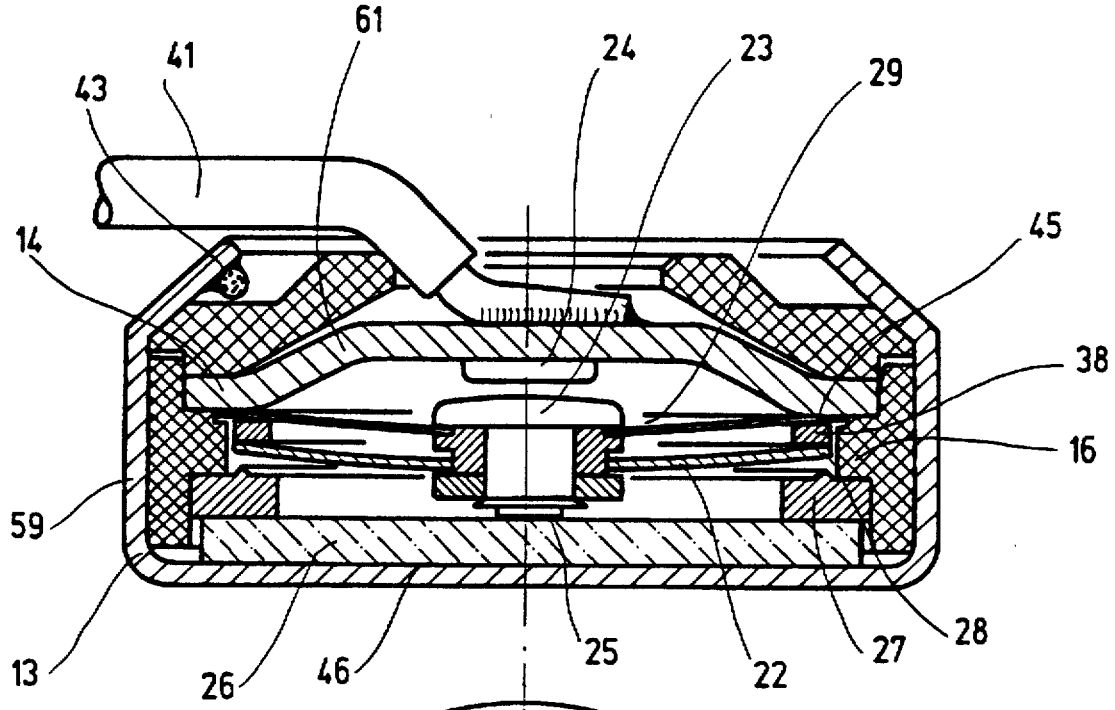
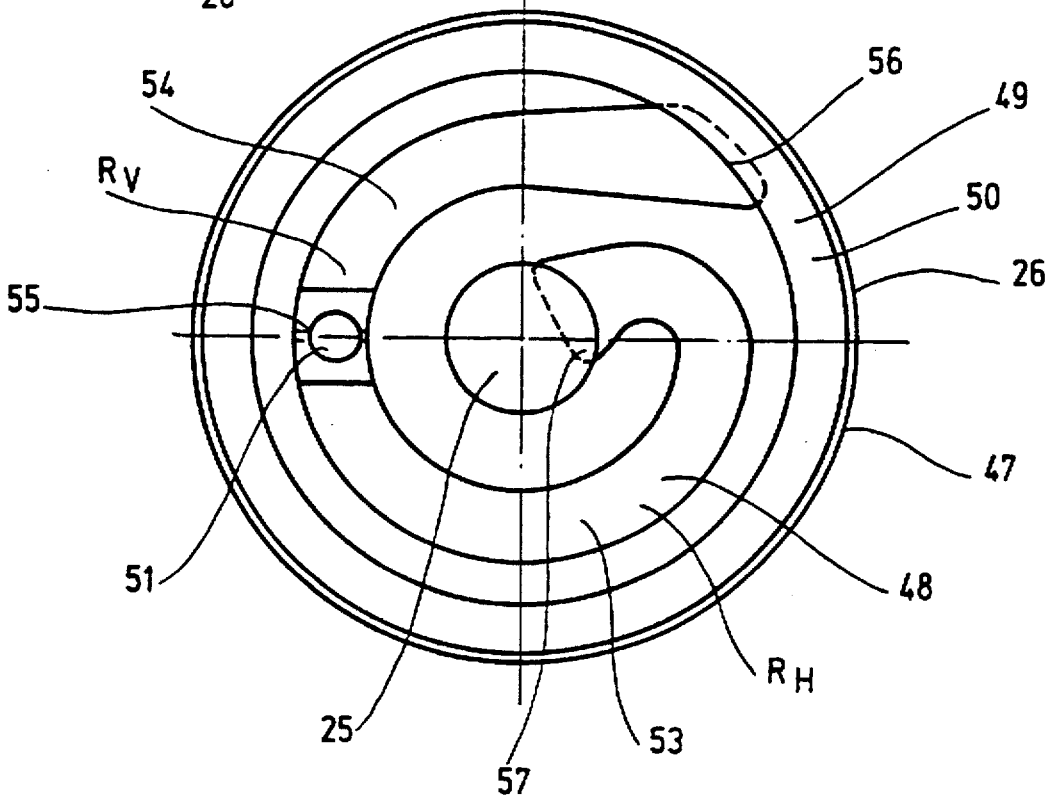
Fig. 3

BIMETALLIC TEMPERATURE CONTROLLER HAVING A RESISTOR FOR SELF-LOCKING FUNCTION AND A RESISTOR FOR EXCESS CURRENT PROTECTION

BACKGROUND OF THE INVENTION

1. Field of the Invention

The present invention relates to a temperature controller with a bimetallic switching device which switches at an excess temperature to protect a consumer, a first heating resistor assigned to the bimetallic switching device which has the effect of a self-locking function when the bimetallic switching device is actuated, and a second heating resistor assigned to the bimetallic switching device which switches the bimetallic switching device when the current flowing through the temperature controller becomes too high, to protect the consumer against excess current.

2. Related Prior Art

Such a temperature controller is known from DE-A-41 42 716.

The known temperature controller comprises a bimetallic switching device which opens at an excess temperature or excess current, to which the first heating resistor is connected in parallel and with which the second heating resistor is connected in series.

A temperature controller known from DE-A-43 36 564 comprises a ceramic carrier plate with a conductive and insulating coating on which an encapsulated bimetallic switching device is arranged, alongside which there is a PTC component which is electrically connected in parallel to the bimetallic switching device and which acts as a first heating resistor. The ceramic carrier plate also bears a thick-film resistor which passes below the bimetallic switching device and is connected in series with this. The protective resistor does not hereby serve as a protection against excess current but to adjust the switching point.

The object of this known temperature controller is to interrupt the flow of current through the electrical consumer if the temperature of this consumer rises excessively or possibly also if the current flowing through the consumer displays excessive values. For this purpose, the known temperature controller is connected in series with the consumer so that the current flowing through the consumer also flows through the temperature controller, whereby the bimetallic switching device is closed at temperatures below the response temperature and/or currents below the response current.

The operating current of the consumer flows through the second heating resistor of a few ohms, which is connected in series, and through the closed contacts of the bimetallic switching device which bridges the first heating resistor. If the temperature of the consumer now exceeds a pre-set limit value, the bimetallic switching device, which is in thermal contact with the consumer, suddenly opens its contacts in that a bimetallic snap disk inside the bimetallic switching devices snaps over. The current now flows through the heating resistor connected in series and through the second heating resistor, whose resistance is so great that the current is much smaller than the original operating current, so that the consumer is switched off, in a manner of speaking. As a result of the PTC characteristics of the first heating resistor in the temperature controller in DE-A-43 36 564, the current drops further when this heating resistor heats up. On account of the heat radiation and/or conduction from this heating resistor, the bimetallic spring disk is heated up further so that it remains self-locked in the position with open contacts. This prevents an automatic re-connection of the consumer which has been switched off due to an excess temperature following cooling, which could lead to a so-called contact flutter with periodic connection and disconnection and is usually undesirable.

If, on the other hand, the current and not the temperature through the consumer, and thus the bimetallic switching device, reaches a pre-set limit value, the heating resistor connected in series heats up in accordance with the description in DE-A-41 42 716 to such an extent that the switch mechanism finally reaches its response temperature and opens. The self-locking in this case is effected in the same manner as described above.

Although the temperature controller known from DE-A-43 36 564 fulfils a number of functional requirements, a disadvantage is that it is relatively bulky and large, due in particular to the ceramic carrier plate. For reasons of accommodation and thermal capacity, such temperature controllers are normally of a very small design, for example they have a diameter of 10 mm and a height of 5 mm, which places extreme requirements on the manufacturing accuracy and also necessitates a simple yet functionally reliable construction.

Such a miniature design of a temperature controller with self-locking through a heating resistor connected in parallel and a heating resistor connected in series which is integrated in a very small space for current monitoring is known from the generic DE-A-41 42 716. The protective resistor is an etched or punched part or a film printed with a resistor and is arranged in the direct vicinity of the spring disk of the bimetallic switching device, being in thermal and electrical contact with this, in such a way that it lies in the bottom half of the housing.

Apart from the complicated assembly of the known temperature controller, a further disadvantage is the fact that the etched or punched part used here as a heating resistor is not very accurate with respect to the resistance value and can only be made for a small resistance range. Moreover, an additional insulating component is also needed between the bottom of the housing and the heating resistor, and generally an additional, externally-mounted high-impedance resistor in series to the aforementioned protective resistor for reasons of resistance adjustment, which on the whole increase the costs of construction and overall dimensions.

In the known temperature controllers, the two heating resistors are either connected in series or in parallel when the bimetallic switching device is inoperative so that the thermal output of both heating resistors has to be taken into account when adjusting the switching behaviour. In the event of deviant conditions, both resistors often have to be re-dimensioned, so that two new components are needed during manufacturing. This has the common disadvantages of stocking, etc.

In the known temperature controllers an additional disadvantage is often the fact that there is a fixed resistance path between the two terminals of the temperature controller so that even if the bimetallic switching device is defective, e.g. due to serious corrosion, a current still flows through the temperature controller. As a result of this, the user may get the misleading impression that the temperature controller is still in working order after long periods of use even though this is no longer the case on account of corrosion or similar mechanical influences.

SUMMARY OF THE INVENTION

In view of the above, it is an object of the present invention to provide a completely new temperature controller which can be easily adapted to different requirements, which is also of a simple design and easy to assemble, whereby the operational reliability should also be improved.

This object is achieved by the invention in that the bimetallic switching device is provided as change-over switch and is connected to both heating resistors in such a way that in each of its switch positions it takes over the current flowing through the temperature controller via a current-carrying part.

The object underlying the invention is thus achieved in full. Since the bimetallic switching device is provided as a change-over switch or double-throw switch, the direction of the current flow is now always actively determined by the bimetallic switching device, the current always flows through the switch mechanism. This means that on the one hand, defined temperature conditions are achieved, if for instance a resistance is provided on the spring disk for an exact adjustment of the temperature switching threshold, for example.

The complete break with the principle of a pure opening, such as is known from the state of the art, where a heating resistor is bridged when the bimetallic switching device is closed, also offers further constructional advantages which will be explained in more detail in the following.

For example, it is possible to provide two separate heating resistors, only one of which is switched via the bimetallic switching device between the terminals of the temperature controller depending on the switching state. In this way, the two heating resistors can be dimensioned separately so that only one of the two resistance components needs be altered and replaced during manufacture in the event of alterations to the current sensitivity or the current strength leading to the self-locking function.

The two heating resistors can also be implemented in the manner of a potentiometer with centre tap through a single resistor so that only one component is used to implement both the self-locking function and the current sensitivity. Only this one component then has to be replaced in the event of different requirements.

A further advantage of the new temperature controller is that if the current-carrying part is destroyed or damaged, e.g. through corrosion or mechanical influences, current can no longer flow through the temperature controller so that the disadvantages known from the state of the art can be avoided.

Since the bimetallic switching device functions as a change-over switch, there is a shorter interruption to the flow of current during this switching process on account of the construction. Depending on the pre-set switching speed of the bimetallic switching device, there may be either imperceptibly short or intentionally longer interruptions to the current which can, for example, be used in the consumer to be protected to reset this into a faultless operating state. In the state of the art, this measure could only be implemented with purely opening temperature controllers, in other words without self-locking function and current sensitivity, since the constant, high-ohmic connection between the two terminals of the temperature controller did not allow a temporary interruption in the current. In the new temperature controller on the other hand, this temporary interruption in the current is possible even though not only the self-locking function but also the current sensitivity can be implemented.

The new temperature controller thus represents a general gain to technology on account of its completely new functional principle, since new fields of application are opened up for this temperature controller.

In embodiments of the new temperature controller it is thus preferred if the bimetallic switching device is connected in series with one or the other of the heating resistors between terminals of the temperature controller depending on the switching state, if both heating resistors are connected in series between the terminals of the temperature controller in one of the two switching states and possibly if the two heating resistors are implemented by a single resistor with centre tap.

These measures are advantageous combinations of how the two heating resistors can be technically implemented.

On the whole it is preferred if the bimetallic switching device displays a switching tongue, preferably of bimetal, clamped on one side as a current-carrying part, whose free end bears a movable change-over contact to which a fixed switching contact is assigned in each switch position of the bimetallic switching device.

The advantage of this is that a relatively simple temperature controller is provided in which the switching tongue is switched between its two switch positions by the temperature inside the temperature controller.

In this embodiment it is then preferred if the switching tongue is connected with its clamped end via the second heating resistor to a first terminal, the first switching contact directly to a second terminal and the second switching contact via the first heating resistor to the second terminal of the temperature controller.

The advantage of this is that a temperature controller of a very simple design can be provided which uses the new functional principle.

In a different embodiment, it is preferred if the bimetallic switching device comprises a first fixed switching contact connected to a first terminal of the temperature controller, a second fixed switching contact connected to a second terminal of the temperature controller and a movable switching contact assigned to the fixed switching contacts which is borne by a spring disk moved by a bimetallic snap disk and which makes conductive contact with the spring disk.

The advantage of this measure is that a further embodiment of the new temperature controller concept is provided in which the current does not flow via the bimetallic snap disk but via the spring disk so that the bimetallic snap disk itself is not affected by the current. The fixed switching contacts can either be connected directly to the terminals of the temperature controller or via heating resistors, whereby the edge of the spring disk can be either fixed in position or connected to the terminals via heating resistors depending on the switching state. As for the two heating resistors, one can be arranged on the cover and the other on the housing base, for example.

In a further development it is preferred if the edge of the spring disk is guided loosely and is connected directly or via one of the two heating resistors to the second terminal of the temperature controller in its first switch position and to the first terminal of the temperature controller in its second switching position, whereby the first switching contact is preferably connected directly to the first terminal and the second switching contact via the first heating resistor to the second terminal, and the edge of the spring disk is connected to the second terminal via the second heating resistor or directly to the first switching contact depending on the switch position.

The advantage of this is that the change-over can be achieved in a very simple constructional manner in that both the movable switching contact as well as the edge of the current-carrying spring disk make contact with another part of the temperature controller depending on the switch position. In this surprisingly simply manner it is possible to implement the change-over function with no great constructional alterations to existing temperature controllers.

It is hereby preferred if the movable switching contact passes roughly through the centre of the bimetallic snap disk and the spring disk and joins these two captively in the manner of a double-headed rivet.

The advantage of this measure is that the bimetallic switching device can be pre-assembled as it were, so that the entire temperature controller can also be assembled by untrained labourers or automatically.

It is then generally preferred if such a temperature controller comprises a housing to accommodate the bimetallic switching device, consisting of a pot-like base closed by a cover, whereby at least the base is made of electrically conductive material and the two heating resistors are arranged beneath the bimetallic switching device on the bottom of the base.

The advantage of this is that a so-called encapsulated temperature controller is provided which is very insensitive to environmental influences since, for example, no moisture can penetrate the controller. The two heating resistors can hereby be provided either directly on the bottom or on a carrier resting on the bottom, whereby it is also possible to provide one heating resistor inside and the other outside.

It is, however, preferred if a carrier part is inserted into the base on which the two heating resistors are preferably provided in thick-film technology.

There are a whole series of advantages connected with this measure. Firstly the resistor planned for the self-locking function can hereby be provided in an economical thick-film technology so that the PTC resistors often used in the state of the art are no longer needed. Moreover, the two heating resistors are provided as one single component so that the assembly of such temperature controllers, in which a self-locking function and excess current sensitivity are desired, can be greatly simplified. Finally, this measure is also advantageous from the point of view of stocking since only one carrier disk with corresponding resistors is provided for various combinations of heating resistors, thus halving the number of parts which have to be stocked.

It is further preferred if the two heating resistors are connected in series, if the free end of one heating resistor is connected to the second switching contact, if the common terminal of both heating resistors is connected to the second terminal and if the free end of the other heating resistor is connected to an electrically conductive projection on which the edge of the spring disk rests in its first switch position.

This is a further switching variant for the new temperature controller which is easy to implement and which combines the aforementioned advantages.

It is then also preferred if the cover is made of an electrically conductive material and is electrically insulated from the base and if the first fixed switching contact is arranged on the cover, whereby the edge of the spring disk in its second switch position may rest on the bottom of the cover via an electrically conductive spacing piece.

The advantage of this is that in principle, conventionally encapsulated temperature controllers can be converted so that they show the new switching principle. All that is needed is to use a bimetallic switching device as described above, beneath which a carrier plate bearing the two heating resistors is arranged. During the normal function of the bimetallic snap disk in interaction with the spring disk, the latter namely rests on the base of the housing in its inoperative position and hereby presses the movable switching contact against the first fixed contact. When the temperature rises, the bimetallic snap disk snaps over, so that the spring disk also changes from a convex to a concave shape and now rests against the underside of the cover, whereby its middle part now presses against the base of the housing. Through the new measure described above, the spring disk now also makes a conductive contact, namely between the two fixed switching contacts on the base of the housing and the edge of the cover.

It is further preferred if the base is a deep-drawn or punched part made of electrically conductive material and if one or both of the heating resistors are provided on the bottom of the base before or after deep-drawing or punching.

For the cover it is also preferred if this is a deep-drawn or punched part made of electrically conductive material, whereby one or both of the heating resistors can also be provided in the cover before or after deep-drawing or punching.

The advantage of these measures is that they spare further manufacturing steps in a simple manner, since the heating resistors no longer have to be provided as separate parts. The heating resistors are rather applied on the smooth surface before or after final production of the cover and base, e.g. in thick-film technology with an interim insulating layer. During the further course of assembly of the new temperature controller, all that needs be done is to insert the bimetallic switching device, which may also be pre-assembled, into the base of the housing and then place the cover onto the base, inserting an interim insulating layer, and then join these two parts together, e.g. by crimping.

The last named measures are thus also of particular advantage in connection with an economical and reliable, possibly also automated final assembly of the new temperature controller.

In a temperature controller of the type described above, the first heating resistor can optionally be replaced by an insulating part and/or the second heating resistor by a short-circuit part, so that with an otherwise identical constructional design, the temperature controller optionally assumes the function of protection against overheating and possibly protection against excess current and/or self-locking. This creates a sort of modular system for the new temperature controller, which brings particular advantages if the two heating resistors are arranged on the carrier disk since different carrier disks then only have to be used to give the otherwise unchanged temperature controller various functions. However, this measure is also advantageous if the temperature controller displays a bimetallic switching tongue since the two heating resistors can then be optionally replaced by corresponding insulating or short-circuit parts which have the same geometric dimensions. Since this type of temperature controller is frequently open and is a very simple component, the increased stocking of a number of different parts is justifiable, the costs are only insignificantly increased. However, since the overall assembly and all other structural parts of the new temperature controller remain unchanged, the final assembly of such new temperature controllers is very simple and can be automated so that the manufacturing costs on the whole can be greatly reduced.

Further advantages can be derived from the description and enclosed drawing.

It is understood that the aforementioned features and those to be explained in the following can be used not only in the specified combinations but also in other combinations or alone without going beyond the scope of the present invention.

BRIEF DESCRIPTION OF THE DRAWINGS

Embodiments of the invention are shown in the drawings and will be explained in more detail in the following description.

FIG. 2 is a view the same as FIG. 1, though the bimetallic switching device has now switched;

FIG. 3 is a top view of the carrier bearing the heating resistors for the temperature controller in FIG. 1 and FIG. 2;

DESCRIPTION OF PREFERRED EMBODIMENTS

Figure 1:
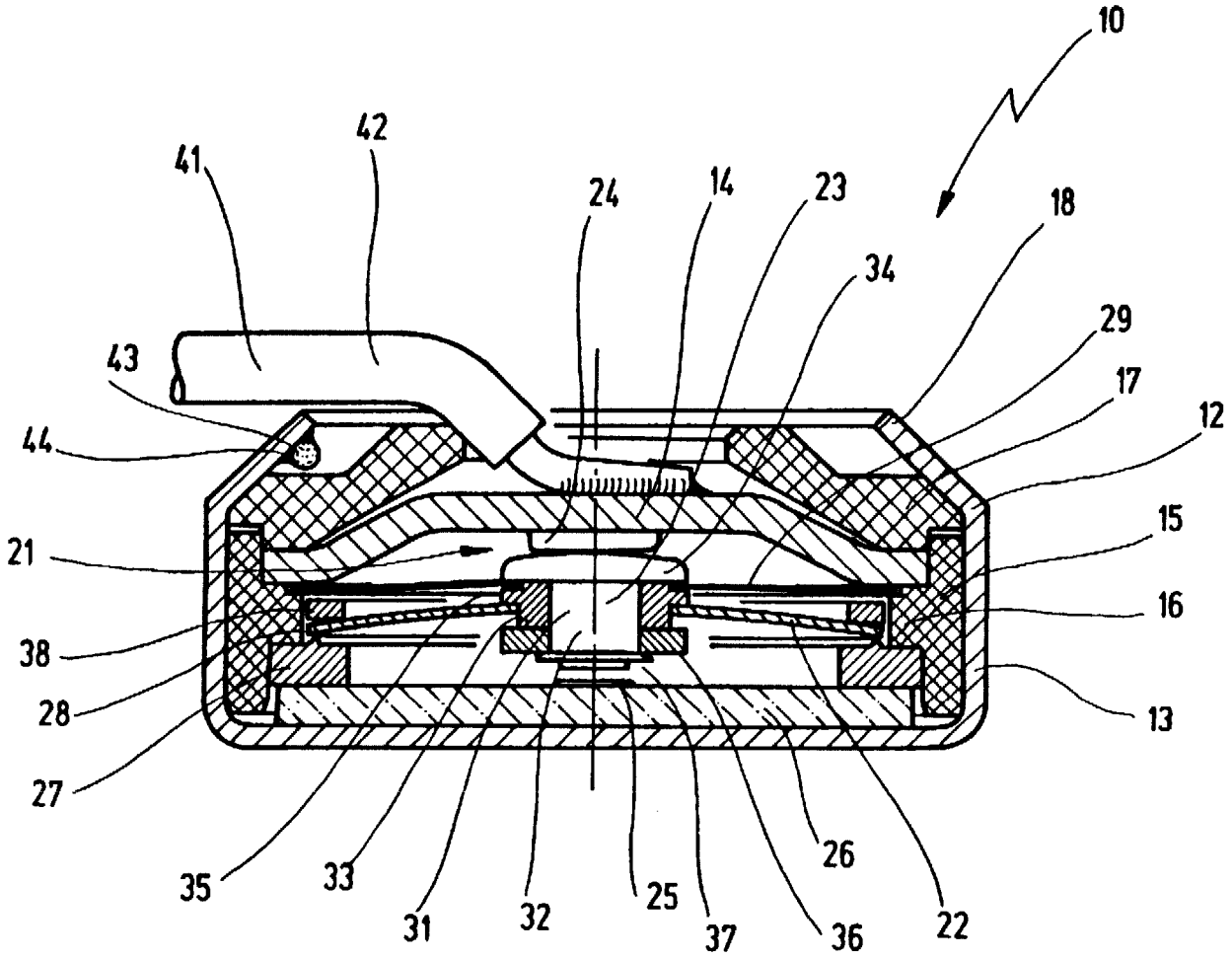
FIG. 1 is an axial section through the new temperature controller whereby the bimetallic switching device is in its first switch position.

FIG. 1 shows a new temperature controller 10, comprising a housing 12 which displays a base 13 and a cover 14 which closes this. Inside the temperature controller 10 there is an insulating ring 15 with a T-shaped cross-section which rests against the side of the base 13. A stay 16 protrudes inwards from roughly the centre of this insulating ring 15 on which the cover 14 rests. A sort of insulating cap 17 is arranged on the cover 14 which is pressed against the cover 14 by a protruding and crimped edge 18 of the base 13. The cover 14 is insulated from the base 13 in this manner yet still rests firmly in this.

There is a bimetallic switching device 21 beneath the cover 14 comprising a spring disk 22 bearing a movable switching contact 23. The switching contact 23 is assigned a first fixed contact 24 on the underside of the cover 14 and a second fixed switching contact 25, arranged on a carrier part 26 which lies in the bottom of the base 13.

The carrier part 26 has a contact ring 27 on which the outer edge 28 of the spring disk 22 rests. Above the spring disk 22 there is a bimetallic snap disk 29 whose edge lies between the stay 16 and the cover 14.

The movable switching contact 23 is provided in the manner of a rivet 31 and holds the spring disk 22 and bimetallic snap disk 29 together as follows:

The rivet 31 displays a neck 32 on which a ring 33 with a T-shaped cross-section is arranged. The bimetallic snap disk 29 is held between the upper head 34 of the rivet 31 and a stay 15 of the ring 33, whereas on the other side of the stay 35, the spring disk 22 is held loosely between the stay 35 and a washer 36 against which the lower head 37 of the rivet 31 rests.

In this way, the bimetallic switching device 21 is pre-assembled of captive parts so that it can be inserted as a whole into the base 13 of the temperature controller 10 during assembly.

In the area of the loose edge 28, there is a further electrically conductive spacer ring 38 between the spring disk 22 and the bimetallic snap disk 29.

FIG. 1 also shows a first terminal 41 for the temperature controller in the form of a litz 42 soldered onto the cover 14, whereas a second terminal 43 in the form of a litz 44 is connected to the base 13 via the edge 18.

In FIG. 1 the temperature controller 10 is shown at a temperature below the switching temperature of the bimetallic switching device 21. The current flows through the temperature controller 10 from the first terminal 41 via the cover 14 and the first fixed switching contact 24 on the movable switching contact 23, from here via the spring disk 22 to the contact ring 27. From the contact ring 27 the current passes to the resistors on the carrier part 26, not shown in more detail in FIG. 1, which in turn makes electrically conductive contact with the base 13, from where the current then flows to the second terminal 43.

If the ambient temperature rises or the current flowing through the temperature controller 10 is too high, the bimetallic switching device 21 switches over to the position shown in FIG. 2. It can be seen that the edge of the bimetallic snap disk 29 now rests on an outer lower edge 45 of the cover 14, whereas the movable switching contact 23 now rests against the second fixed switching contact 25. It can also be seen that the spring disk 22 has also snapped over and no longer makes electrically conductive contact with the contact ring 27. The spring disk 22 is now connected to the edge 45 of the cover 14 via the spacer ring 38.

Simply for the sake of completeness, it should be mentioned that the relative positions of the spring disk 22 and bimetallic snap disk 29 can also be exchanged so that the spring disk 22 lies above t he bimetallic snap disk 29, without affecting the function of the bimetallic switching device 21.

The current now flows through the temperature controller 10 from the terminal 41 via the cover 14 and the edge 45 into the spring disk 22 and from here via the movable switching contact 23 to the fixed switching contact 25 on the carrier part 26 which is arranged on the bottom 46 of the base 13.

FIG. 3 shops a top view of this carrier disk 26, which is preferably a ceramic disk 47, for example made of $Al_2O_3$ or a different material. There is a thick-film resistor 48 on the carrier disk 47 which extends spirally between the fixed switching contact 25 and a circular contact bank 49 or an external projection 50. The thick-film resistor 48 has a through-connection 51 in roughly its centre which leads to the underside of the carrier part 26 and here makes electrically conductive contact with the bottom 46 of the base 13.

In this way the thick-film resistor 48 is divided into two resistors, namely into a first heating resistor 43 between the fixed switching contact 25 and the through-connection 41, and a second heating resistor 54 between the through-connection 51 and the contact bank 49. The through-connection 51 thus acts as a sort of centre tap 55, which divides the thick-film resistor 48 into a holding resistor RH for the self-locking function identified as 53 and a protective resistor Rv for the current sensitivity identified as 54.

The protective resistor Rv is connected to the projection 50 at its free end 56, whereas the heating resistor RH is connected to the switching contact 25 at its free end 57.

Figure 4:
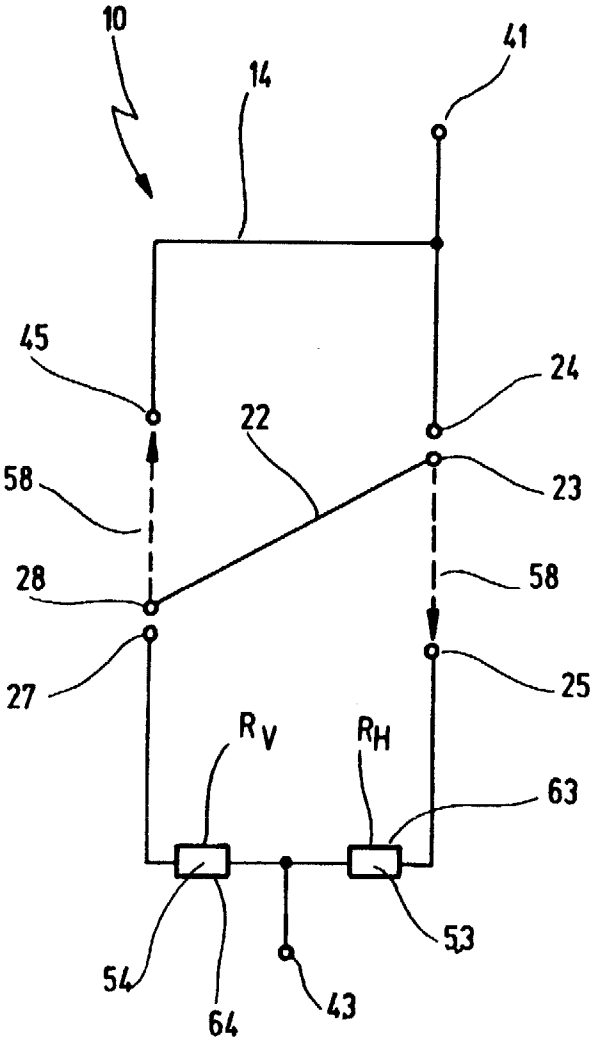
FIG. 4 is an electric equivalent circuit diagram of the temperature controller shown in FIG. 1 to 3.

FIG. 4 shows an electric equivalent circuit diagram for the temperature controller 10 described up to now. It can be seen that the spring disk 22 acts as a sort of change-over switch or double-throw switch, which on the one hand switches the protective resistor 54 between the two terminals 41 and 43 and, when the temperature rises, moves in the direction of the arrow 58 and thus then switches the heating resistor 53 between the terminals 41 and 43. In other words, depending on the switching state of the bimetallic switching device 21, either only the heating resistor 54 or the heating resistor 53 is switched between the two terminals 41 and 43. The manner in which the current sensitivity and the self-locking function is effected by the heating resistors 53, 54 has been explained in more detail at the beginning, so that we refer you to this section of the description so as to avoid repetition.

Since both heating resistors 53, 54 are provided on the carrier part 26, only this carrier part 26 has to be replaced if other resistance values are desired for the heating resistors 53, 54. Alternatively, it is also possible to design the two heating resistors 53, 54 directly on the bottom 46 of the base 13, which can for example, be a deep-drawn or punched part 59 (see FIG. 2).

If the carrier part 26 is used, it is also possible to replace the heating resistor 53 by an insulating part 63 and/or the heating resistor 54 by a short-circuit part 64 so that the temperature controller 10 displays no self-locking function and/or no excess current sensitivity. Thus, a total of four differently assembled carrier parts 26 are required to provide all four variants of the temperature controller 10, namely purely overheating protection, overheating protection with self-locking function, overheating protection with current sensitivity and overheating protection with self-locking function and current sensitivity. The assembly sequence and all other parts in the new temperature controller 10 do not have to be altered.

Figure 5:
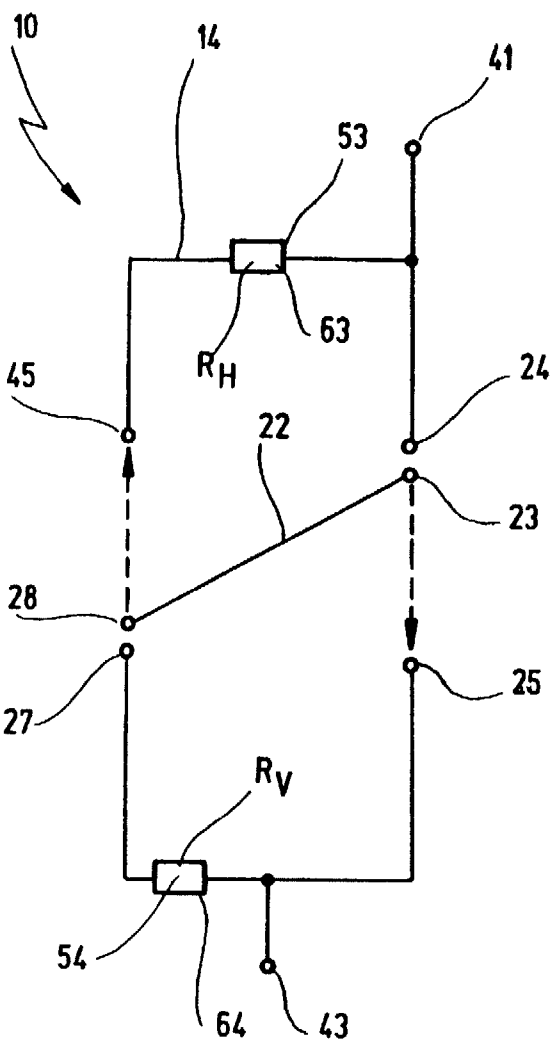
FIG. 5 is an electric equivalent circuit diagram for an alternative embodiment of the temperature controller shown in FIG. 1 to 4.

FIG. 5 shows a equivalent circuit diagram similar to that in FIG. 4, though for a modified embodiment of the new temperature controller 10. Whereas the protective resistor 54 is still provided on the bottom 46 of the base 13, the heating resistor 53 responsible for the self-locking function is now in the cover 14. It may in this case be possible to provide the inside of the cover with a thick-film resistor between the edge 45 and the fixed switching contact 24. However it is also possible to make the cover of a PTC ceramic so that it displays the necessary resistance itself.

In this embodiment too, it is of course possible to replace the heating resistors 53, 54 by and insulating part 63 and a short-circuit part 54 respectively.

Figure 6:
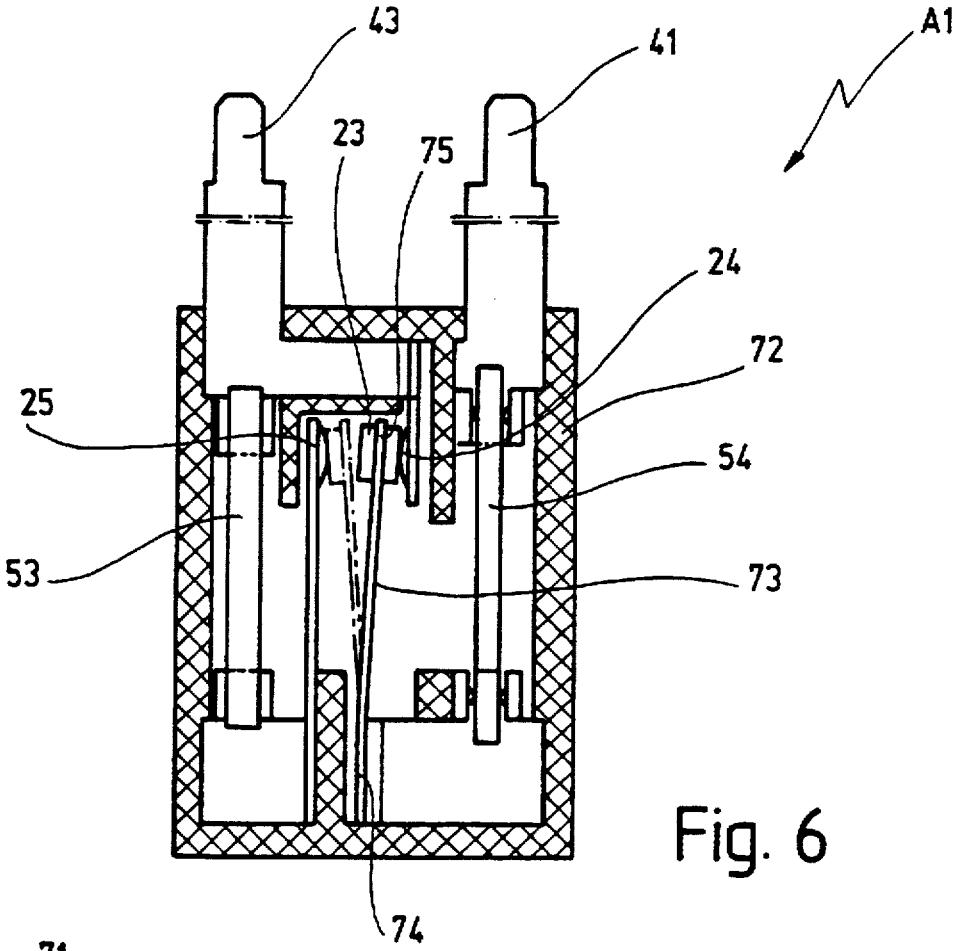
FIG. 6 is a further embodiment of the new temperature controller in which a bimetallic switching tongue is used.

FIG. 6 shows a further embodiment in cross-section of a so-called open housing temperature controller 71 which displays a plastic frame as carrying housing part, indicated schematically at 72. Comparable structural features with the same reference numbers as in FIG. 1 to 5 are shown in FIG. 6 to facilitate an understanding of the construction.

The two terminals 41, 43 are arranged on the frame 72 in the form of lugs, which a re suitably affixed to the frame 72. Moreover, there is a switching tongue 74 of bimetal clamped on one side inside the frame 72, whose clamped end 74 is connected to the first terminal 41 via the second heating resistor 54.

The free end 75 of the switching tongue 73 bears the movable switching contact 23, which is assigned the first switching contact 24 and the second switching contact 25. The first switching contact 24 is directly connected to the second terminal 43 whereas the second switching contact 25 is connected to terminal 43 via the first heating resistor 53.

Figure 7:
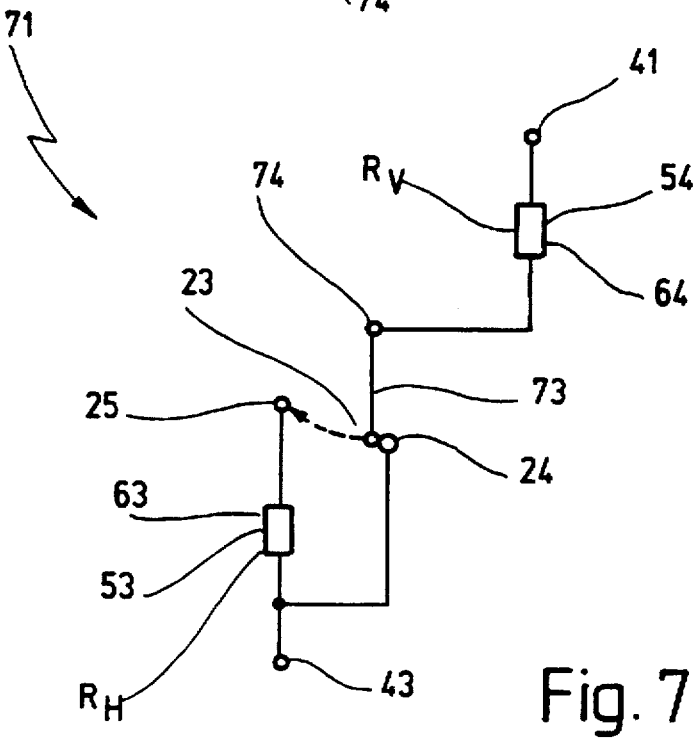
FIG. 7 is an electric equivalent circuit diagram for the temperature controller in FIG. 6.

FIG. 7 shows an electric equivalent circuit diagram of the temperature controller 71 from FIG. 6. It can be seen that in this embodiment, the protective resistor Rv is either connected alone or in series with the heating resistor RH between the two terminals 41 and 43. The switching tongue 73 hereby takes over the respective flowing current, whereby it either makes contact with the first switching contact 24 or the second switching contact 25.

With this temperature controller 71 too, it is if course possible replace the heating resistors 53, 54 by an insulating part and a short-circuit part 64 respectively, so that once again principle of a modular system is given.

What we claim is:

1. A temperature controller, comprising a bimetallic switching device that changes between at least two switch positions in response to temperature variations, a first heating resistor connected to said bimetallic switching device and arranged such that it heats said bimetallic switching device when the latter is actuated, in order to provide for a self-locking function, and a second heating resistor connected to said bimetallic switching device and arranged such that it heats said bimetallic switching device in such a way that it switches the latter when current flowing through said temperature controller exceeds an excess temperature, said bimetallic swithching device comprising a current carrying part and being connected to said two heating resistors in such a way that in both of said at least two switch positions the current flows through the current carrying part.

2. The temperature controller in accordance with claim 1, wherein depending on the switching state the bimetallic switching device is connected in series with one or the other of the heating resistors between terminals of the temperature controller.

3. The temperature controller in accordance with claim 1, wherein depending on the switching state the bimetallic switching device is connected in series with one or both of the heating resistors between terminals of the temperature controller.

4. The temperature controller in accordance with claim 3, wherein the two heating resistors are implemented by a single resistor with centre tap.

5. The temperature controller in accordance with claim 3, wherein the bimetallic switching device comprises a switching tongue, clamped on one side, as a current-carrying part, whose free end bears a movable switching contact to which a fixed switching contact is assigned in each switch position of the bimetallic switching device.

6. The temperature controller in accordance with claim 5, wherein the switching tongue is a switching tongue of bimetal.

7. The temperature controller in accordance with claim 5, wherein the switching tongue is connected with its clamped end via the second heating resistor to a first terminal, the first switching contact is connected directly to a second terminal and the second switching contact is connected via the first heating resistor to the second terminal of the temperature controller.

8. The temperature controller in accordance with claim 1, wherein the bimetallic switching device comprises a first fixed switching contact connected to a first terminal of the temperature controller, a second fixed switching contact connected to a second terminal of the temperature controller and a movable switching contact assigned to the fixed switching contacts which is borne by a spring disk moved by a bimetallic snap disk and which makes conductive contact with this spring disk.

9. The temperature controller in accordance with claim 8, wherein the edge of the spring disk is guided loosely and is connected directly or via one of the two heating resistors to the second terminal of the temperature controller in its first switch position and to the first terminal of the temperature controller in its second switching position.

10. The temperature controller in accordance with claim 9, wherein the first switching contact is connected directly to the first terminal and the second switching contact is connected via the first heating resistor to the second terminal, whereby the edge of the spring disk is connected to the second terminal via the second heating resistor or directly to the first switching contact depending on the switch position.

11. The temperature controller in accordance with claim 10, wherein the movable switching contact passes roughly through the centre of the bimetallic snap disk and the spring disk and joins these two captively in the manner of a double-headed rivet.

12. The temperature controller in accordance with claim 8, comprising a housing to accommodate the bimetallic switching device consisting of a pot-like base closed by a cover, whereby at least the base is made of electrically conductive material and the two heating resistors are arranged beneath the bimetallic switching device on the bottom of the base.

13. The temperature controller in accordance with claim 12, wherein a carrier part is inserted into the base on which the two heating resistors are provided.

14. The temperature controller in accordance with claim 13, wherein the two heating resistors are connected in series, the free end of one heating resistor is connected to the second switching contact, the common terminal of both heating resistors is connected to the second terminal and the free end of the other heating resistor is connected to an electrically conductive projection on which the edge of the spring disk rests in its first switch position.

15. The temperature controller in accordance with claim 12, wherein the cover is made of an electrically conductive material and is electrically insulated from the base, and the first fixed switching contact is arranged on the cover, whereby the edge of the spring disk may rest on the bottom of the cover via an electrically conductive spacing piece, in its second switch position.

16. The temperature controller in accordance with claim 12, wherein the base is a deep-drawn or punched part made of electrically conductive material, and one or both of the heating resistors are provided on the bottom of the base before or after deep-drawing or punching.

17. The temperature controller in accordance with claim 12, wherein the cover is a deep-drawn or punched part made of electrically conductive material, and one or both of the heating resistors are provided in the cover before or after deep-drawing or punching.

18. The temperature controller in accordance with claim 1, wherein the first heating resistor is optionally replaced by an insulating part and the second heating resistor is optionally replaced by a short-circuit part, so that with an otherwise identical constructional design, the temperature controller optionally assumes the functions of protection against overheating and possibly excess current and/or self-locking.

* * * * *